US008696395B2

(12) United States Patent
Masters

(10) Patent No.: US 8,696,395 B2
(45) Date of Patent: Apr. 15, 2014

(54) PRONE POSITION WATERCRAFT

(76) Inventor: William Adam Masters, Marshall, NC (US)

( * ) Notice: Subject to any disclaimer, the term of this patent is extended or adjusted under 35 U.S.C. 154(b) by 190 days.

(21) Appl. No.: 13/211,638

(22) Filed: Aug. 17, 2011

(65) Prior Publication Data

US 2012/0156950 A1 Jun. 21, 2012

Related U.S. Application Data

(60) Provisional application No. 61/459,655, filed on Dec. 15, 2010.

(51) Int. Cl.
*B63B 1/00* (2006.01)

(52) U.S. Cl.
USPC ..... 441/65; 441/74

(58) Field of Classification Search
USPC ..... 114/345, 357; 280/18; 441/55, 65, 74
See application file for complete search history.

(56) References Cited

U.S. PATENT DOCUMENTS

| | | | | |
|---|---|---|---|---|
| 4,603,870 | A * | 8/1986 | Monreal | 441/65 |
| 5,529,523 | A * | 6/1996 | Wilhelmi | 441/74 |
| 5,603,645 | A * | 2/1997 | Saccomanno | 441/65 |
| 5,797,779 | A * | 8/1998 | Stewart | 441/74 |
| 7,074,098 | B1 * | 7/2006 | Acosta, Jr. | 441/65 |

* cited by examiner

*Primary Examiner* — Lars A Olson
(74) *Attorney, Agent, or Firm* — Southeast IP Group, LLC; Thomas L. Moses

(57) ABSTRACT

A personal watercraft is designed to be ridden in a prone position. The craft is generally shaped like a kayak, including a bow and a stern, and includes a shaped, recessed cavity within the boat to accommodate and conform to the riders body disposed in a prone position, so that the rider can propel and navigate the craft using his arms and hands. The recessed cavity is an ergonomically designed space for the rider's body to be cradled within the craft in a prone position, creating a stable and dynamic platform for water exploits, lowering the center of gravity, and allowing the rider to guide the craft through fast running water by leaning in a desired direction.

13 Claims, 6 Drawing Sheets

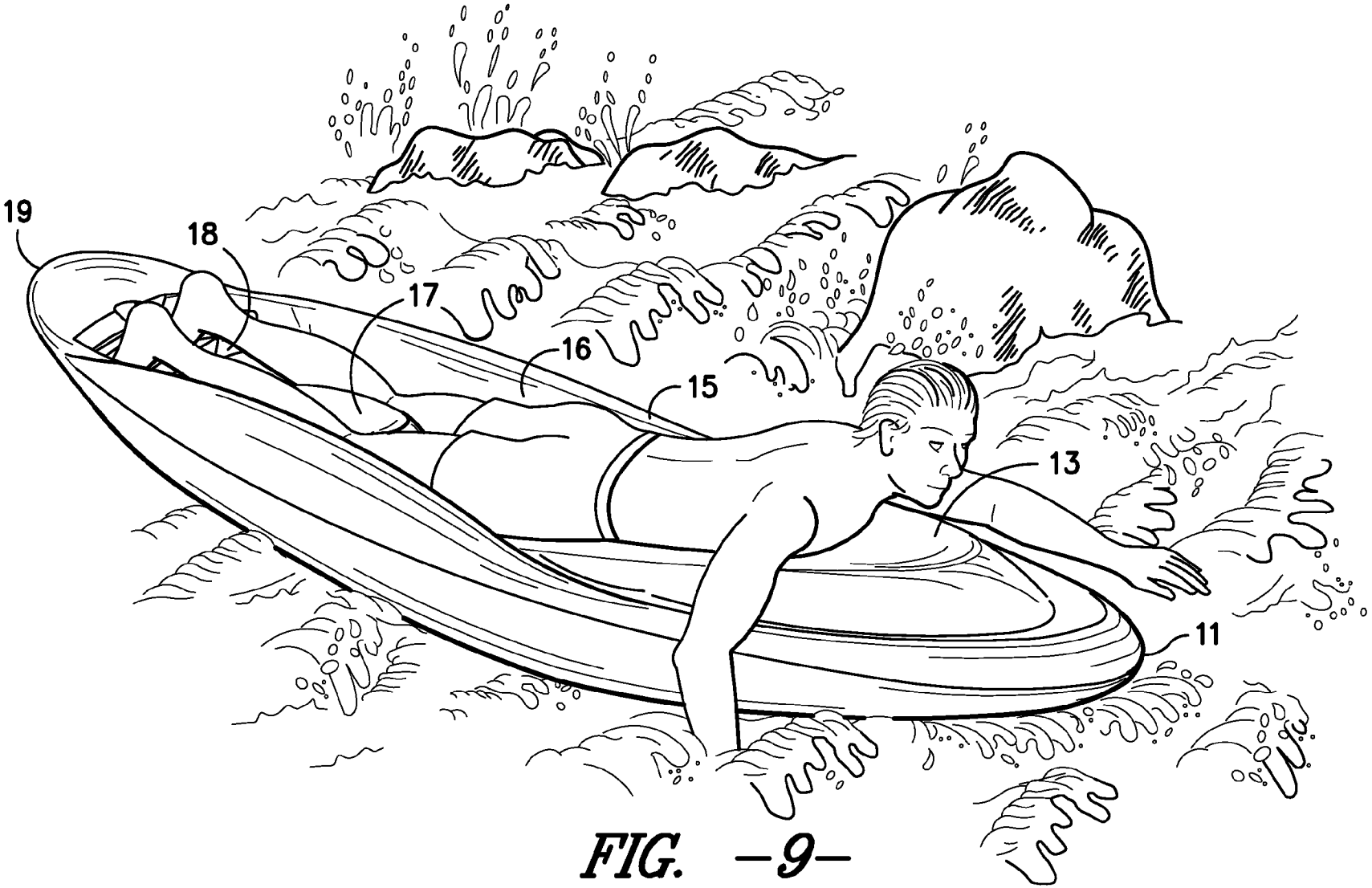
FIG. —9—

PRONE POSITION WATERCRAFT

RELATED APPLICATIONS

This application claims priority to U.S. Provisional Patent Application Ser. No. 61/459,655, filed Dec. 15, 2010.

BACKGROUND

The present invention relates generally to single-person watercraft. More specifically, the present invention includes a watercraft designed to be ridden in the prone position on any body of water, including rivers, lakes, streams or oceans, wherein the rider's body is fully supported by, but not enclosed within the craft and the arms and hands are primarily used to power and direct the craft.

People have used many means to navigate and explore bodies of water, such as canoes, kayaks, surfboards, and body boards. These specific crafts have been developed to facilitate travel on the many unique bodies of water found on the earth. Kayaks and Canoes are compatible with whitewater (rivers), flatwater (lakes), creeks, and oceans. Surfboards are primarily designed to ride wave momentum in ocean surf. Body boards are used in some rivers and in ocean surf.

The rider interface on existing human powered watercraft has several features and disadvantages. Kayaks and canoes have the rider seated in a sitting position. This allows for increased torque with the use of a paddle. However, the seated position also raises the center of gravity, thereby increasing instability. Surfboards are made to be ridden on waves while standing and thus offer little stability in flatwater or on rivers. Although a surfboard can be paddled in a prone position, this is secondary to the intention of the craft. Body boards, or boogie boards, are designed to be ridden in the prone position, but such crafts typically extend only as far back as the pelvis, leaving the lower half of the rider's body exposed to rocks or other hazards below the surface of the water. There is also a substantial amount of drag created by the rider's legs being submerged in the water, creating a loss of speed, limiting directional control, and inhibiting response of the craft to the rider's propulsion. This arrangement limits their use in oceans or on rivers.

In the realm of kayaks and canoes, the skill needed to successfully navigate rough waters has limited the spread of the sport due to the level of skill and gear required. The potential for capsizing is the most often-cited deterrent for people interested in kayaking or canoeing. Having the skill to successfully "roll" in a kayak on whitewater creates a criterion for safety and maneuverability that limits a large segment of interested people from traversing certain bodies of water or even trying the sport. Canoes are heavy and, once turned over, are very difficult to return to a righted position and clear of water. In addition to necessary skill, both kayaks and canoes require a certain amount of gear. Kayaks require sprayskirts to keep the internal cavity from filling with water. The sprayskirt is also a deterrent for many to attempt kayaking, because it can create a fear of being trapped within the craft, particularly underwater, when the craft is in an upside down position. Canoes can require extra flotation to fill up the negative space within the boat.

SUMMARY OF THE INVENTION

The present invention overcomes these limitations by combining the speed and rocker (further shown and described in drawings) of a kayak, and having increased stability by providing a lower center of gravity due to the rider riding in a prone position. In one embodiment, the watercraft is powered by the rider's hands, much like swimming. The craft is formed so that it cradles the full body of the rider on an inner cavity so that the body is completely supported and above water. This reduces the craft's drag and allows the rider to attain speeds greater than swimming. The present invention overcomes the problem of instability of kayaks because the rider is in a prone position. This low center of gravity is much more stable and makes the craft much less likely to flip over. There is no negative space (enclosed) within the craft, therefore it does not allow water to fill within the internal space and act as a weight or drag. The term "negative space," as used herein, refers to space within the craft where water could accumulate, thus weighing down the craft. It is an object of the present invention to provide a craft having a relatively small amount of negative space, so that even if the entire negative space of the craft were filled with water, the craft would remain afloat, and the water could be easily removed therefrom (either by tilting the craft sideways, or by simply splashing the water out of the craft). Therefore, unlike kayaks, there is no need for a sprayskirt, which helps to mitigate the fear of being trapped.

The rider has a high level of stability, but in the case of falling out of the craft, there is nothing to confine or tether the rider to the boat. Furthermore, this craft gives the rider the sensation of flying, as he or she is eye level with the surface of the water. Lastly, the craft is not restricted to use on various bodies of water and actually expands the capability for exploring certain waters that cannot be explored with the current inventory of watercrafts-specifically, small body creeks and streams. Such streams are usually too narrow for canoes and contain low hanging tree branches, restricting the upright positioning of the rider in kayaks and canoes. Body boards are rarely used on such streams due to high numbers of rocks that make up the stream bottom. Surfboards (or stand on top crafts) are not used in narrow creeks or streams.

BRIEF DESCRIPTION OF THE DRAWINGS

These and other features, aspects, and advantages of the present invention will become better understood with regard to the following description, appended claims, and accompanying drawings where:

FIG. 9 is a perspective view of another embodiment of a personal watercraft in use in fast water, further showing a raised central pillar disposed between the user's legs, which is used as a brace.

DETAILED DESCRIPTION OF THE INVENTION

The present invention includes a personal watercraft that is designed to be ridden in a prone position, as shown in FIGS. 1-9. The craft is generally shaped like a kayak, including a bow 11 and a stern 19, and includes a shaped, recessed area 16 within the boat to accommodate and conform to the rider's body disposed in a prone position. The recessed area 16 preferably allows a rider to comfortably position himself or herself therein, so that the rider may be able to easily reach his hands and lower arms into the water for propulsion and navigation. In a preferred embodiment, the lateral sides 15 of the craft are slightly higher adjacent the leg and waist portions of the craft, and are angled slightly inwardly toward the center of the craft, as shown in FIGS. 1, 2, and 5-9. The lateral sides 15 of the craft adjacent a rider's shoulders are designed to be low enough to allow the rider's arms to hang downwardly over the sides of the craft, again for propulsion and navigation. It is further contemplated that the recessed area may be customized for a particular person, based on his or her height, weight and body shape, so that the size and shape of the recessed area conform to that particular person when they are in the prone position on the craft.

Figure 1:
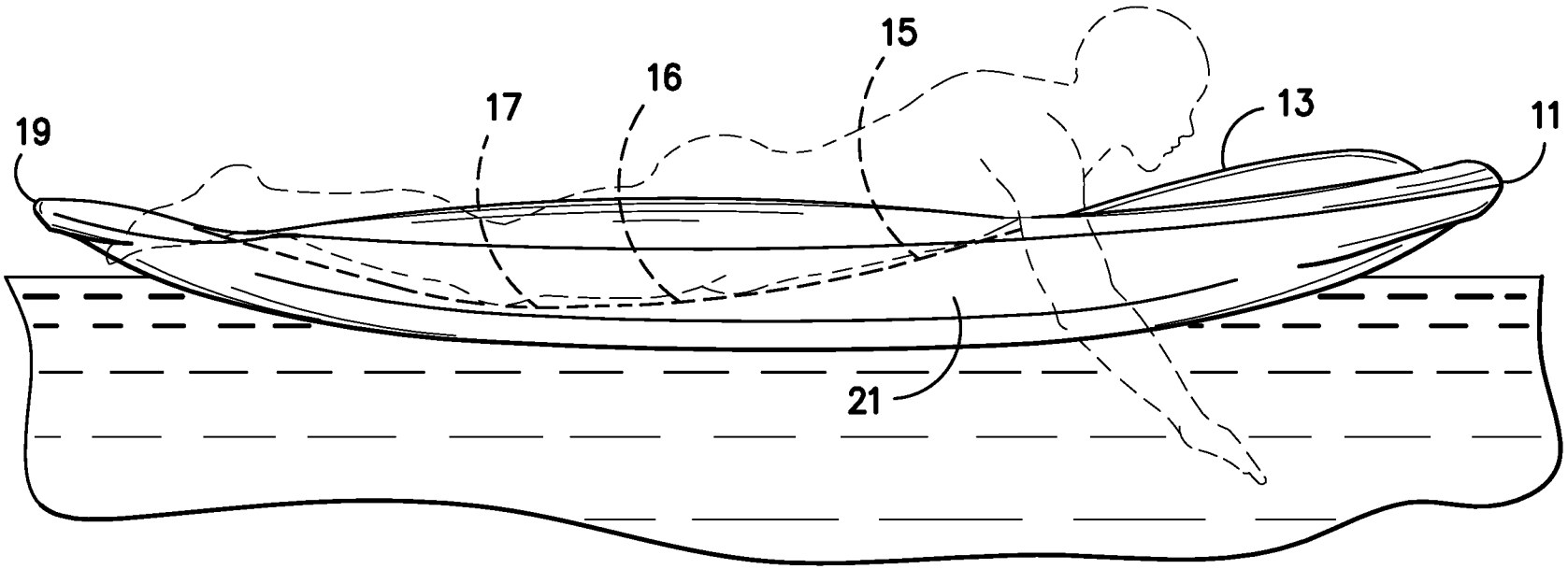
FIG. 1 is a side view of one embodiment of a personal watercraft designed to be ridden in a prone position, further showing a person positioned on the craft in the operating position powering the craft by paddling with his hands.
Figure 2:
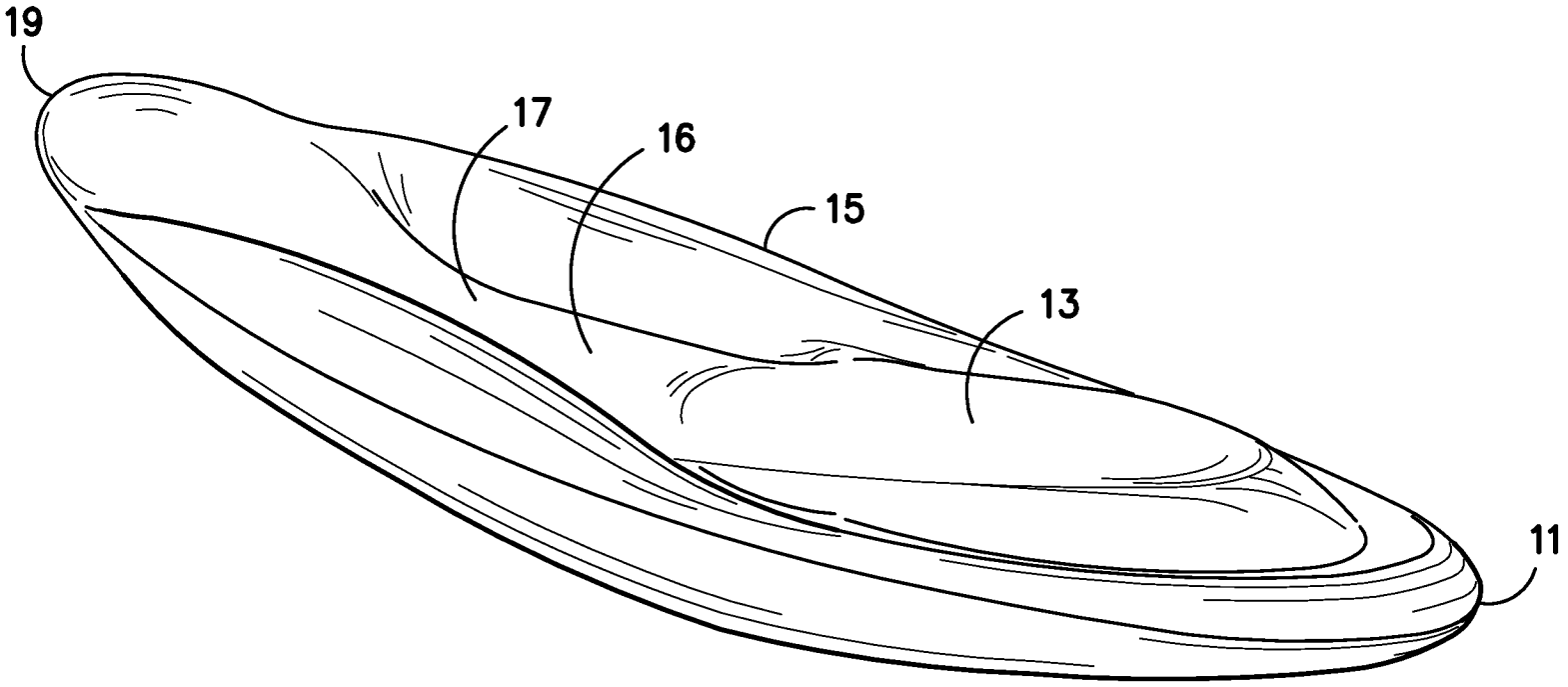
FIG. 2 is a perspective view of one embodiment of a personal watercraft designed to be ridden in a prone position, wherein the inner cavity of the craft is formed to conform to the human shape disposed in a prone position.
Figure 3:
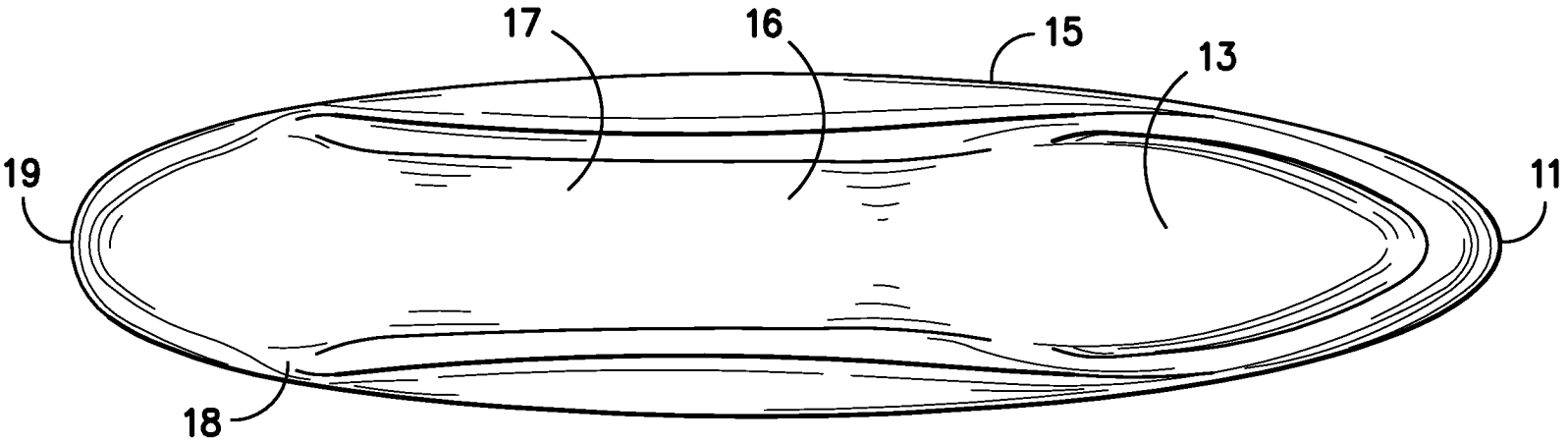
FIG. 3 is a top view of one embodiment of a personal watercraft designed to be ridden in a prone position.
Figure 4:
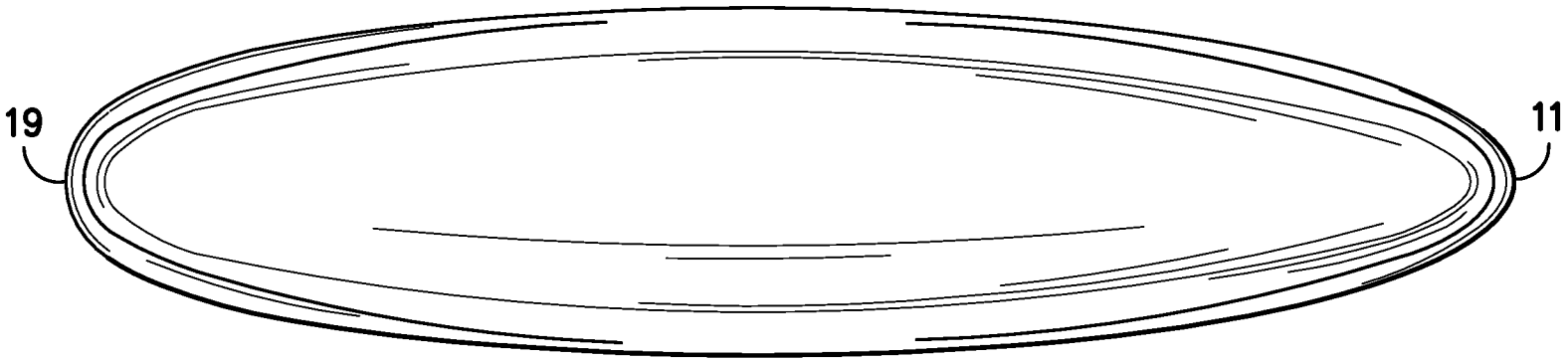
FIG. 4 is a bottom view of one embodiment of a personal watercraft designed to be ridden in a prone position.
Figure 5:
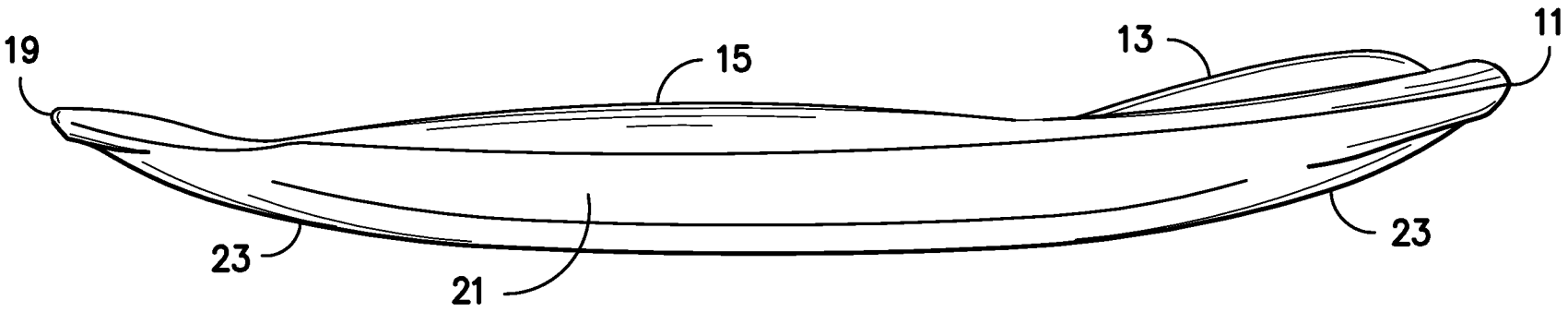
FIG. 5 is a side view of one embodiment of a personal watercraft designed to be ridden in a prone position.
Figure 8:
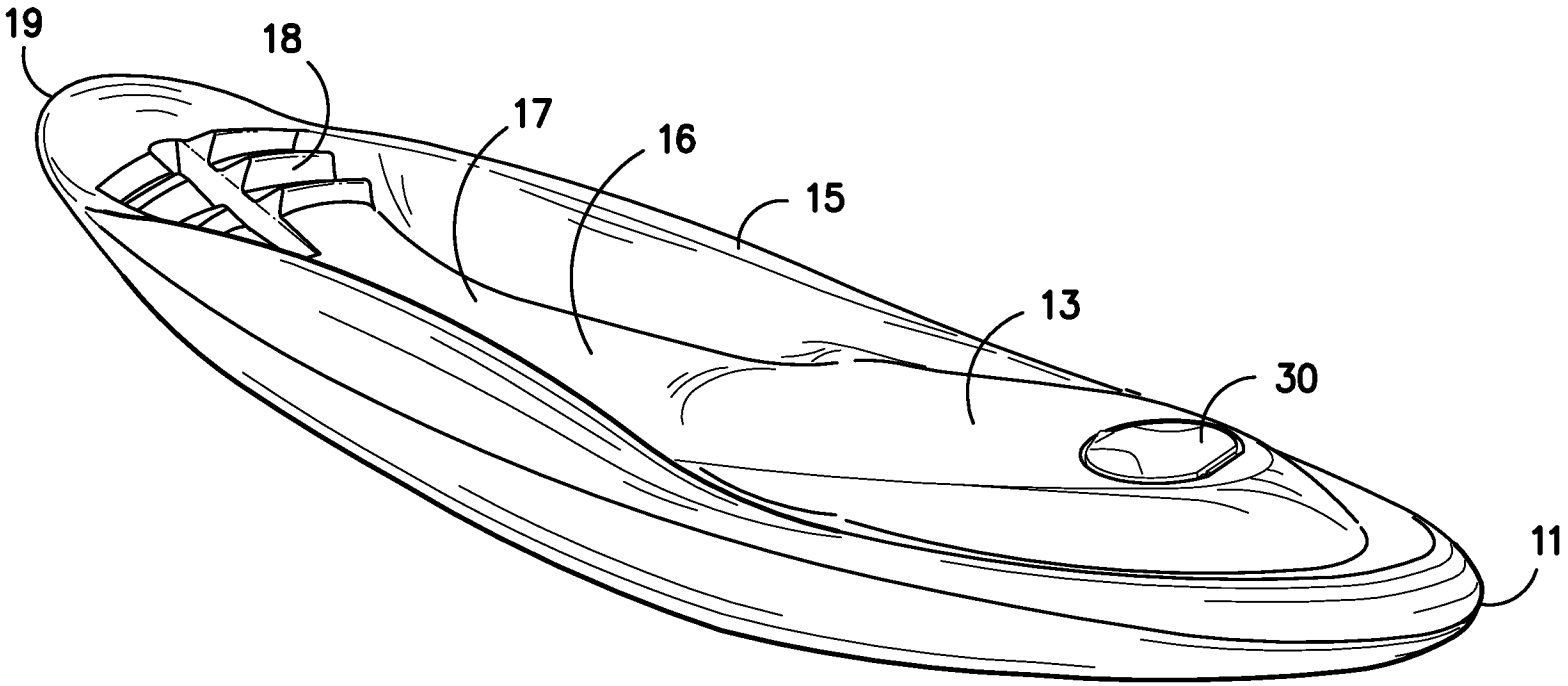
FIG. 8 is a perspective view of another embodiment of a personal watercraft designed to be ridden in a prone position, further including a dry storage hatch position on the bow, and a series of footrests and recesses positioned adjacent the bow.

In one embodiment, the craft includes a recessed area to accommodate the rider's feet, together with footrests 18, as shown in FIG. 8. The chest area 13, in one embodiment, is slightly raised to allow maximum comfort and ergonomics for the rider, and it is preferred that the inside of the craft be designed so that the rider's body is not perfectly horizontal, but rather is designed so that the rider's body is angled slightly upwardly, as shown in FIG. 1. The craft contains rocker 23 along the length of the hull 21. As used herein, the term "rocker" refers to the curvature on the underside or hull 21 of the craft, either in the longitudinal direction 23 or the lateral direction 25, which provides a hydrodynamic element to the craft, and allows the craft to maintain stability in rough waters. The craft preferably includes lateral rocker 25 with the sides 15 of the craft extending slightly inwardly around the rider's body. The craft may optionally include a central pillar 17 for the knees to brace against, as shown in FIG. 9. The craft can be any practical or suitable length and width. The primary function of the craft design is to cradle the rider's body on top of and within a hydrodynamically functional interface, to allow for efficient movement across any body of water, whether static or moving. The hull 21 can be rounded, or flattened, may contain rails and can be a variety of shapes and widths depending on the end use. Other embodiments of the craft may be powered by electric engines with jet drive or internal combustion engines.

The craft may be manufactured using any suitable process. One such method includes the steps of filling a mold shaped like a kayak (an oval shape containing lateral and longitudinal rocker, with the center wider than the ends, with sufficient volume to support the rider) with two part expanding urethane foam. This foam plug is then removed from the mold and the deck space carved to accommodate the rider's body. A recessed area is created with the low point at the center of the boat. The leg area may have a single cavity to accommodate both legs of a rider, or may include two separate cavities, one for each leg (as shown in FIG. 9). Optional features include a central pillar 17 between the legs for support and a recessed area for the feet. The chest area 13 is preferably slightly elevated. The molded craft may then be fiberglassed over using fiberglass cloth, carbon fiber or Kevlar cloth with polyester and/or epoxy resin. The inside, recessed cavity of the craft may then be covered in neoprene, minicell foam or some suitable fabric to protect and hold the rider. This embodiment allows for easy design changes. Other manufacturing processes may include rotational molding, flexible skin over a foam core, injection molding, blow molding, hand carved from foam and covered in a variety of composites, or any other suitable process. It is particularly advantageous to manufacture the personal watercraft so that it has a monolithic design, without the need for multiple sections that must be snapped, glued, or otherwise attached together to form the final product. Such a monolithic design eliminates seams and connections that may tend to leak or come apart during the stress of use. The most cost effective mode of manufacturing the craft would be to rotationally mold the craft, but techniques not yet applied to watercraft such as ethafoam with plastic skin, may yield a lighter and more cost effective craft.

In a preferred embodiment, the rider lies prone in the craft propelling it in any desired direction with his or her hands. The bow 11, as shown in FIG. 1, extends in front of the rider's face. The elevated chest area 13 elevates the rider's head and chest to allow for maximum perspective and mobility. The optional raised humps 15 protect the body and allow the hull to extend around the edge of the craft, creating a continuous profile within the water. This arrangement and design allows the rider to lean left and right without capsizing and to assist in turning the craft. The recessed cavity 16 is an ergonomically designed space for the rider's body to be cradled within the craft, creating a stable and dynamic platform for water exploits.

Figure 6:
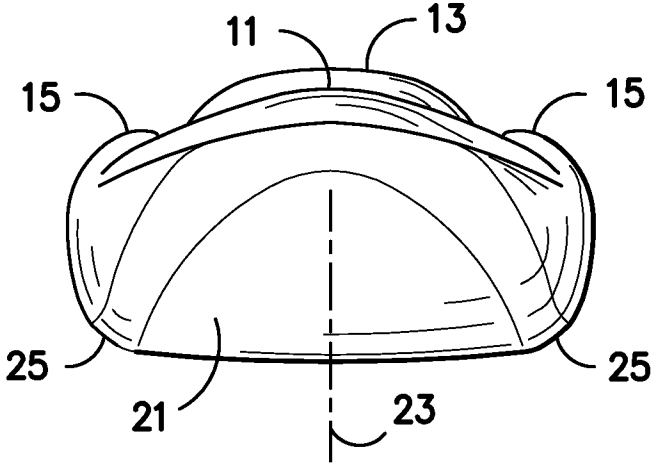
FIG. 6 is a front view of one embodiment of a personal watercraft designed to be ridden in a prone position, showing the bow of the craft.
Figure 7:
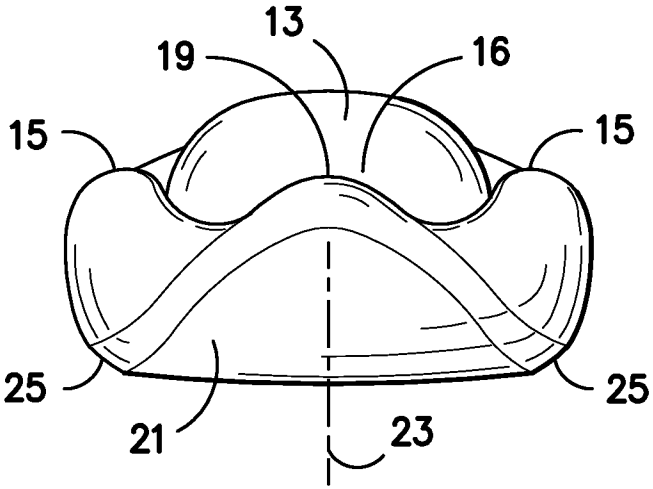
FIG. 7 is a rear view of one embodiment of a personal watercraft designed to be ridden in a prone position, showing the stern of the craft.

The lateral rocker 25, as shown in FIGS. 6 and 7, allows the rider to turn the boat by leaning and creates stable transition for lateral moves. The longitudinal rocker 23 along the length of the craft, shown in FIG. 5, allows the craft to ride up and over waves, while also assisting in maneuverability by allowing the boat to spin along its long axis. The embodiment shown in FIG. 9 includes a raised central pillar 17 in the center that creates a spot for the knees to brace against, allowing the rider to maintain stability within the craft in rough water. The embodiment in FIG. 8 also includes a footrest 18 for bracing the feet of a rider. The stern area 19 may optionally be configured to include or receive a drybag, box, or other means of storage. Optionally, a dry storage area having a hatch 30 may be incorporated into the bow, as shown in FIG. 8. Handles (not shown), may be attached to the craft, as well.

As mentioned heretofore, it should be understood that the craft may be used in any kind of water, including oceans, rivers, lakes, creeks, or even as a swimming aid in a swimming pool. Further, although the craft is designed for a person to ride in a prone position, it should be understood that a rider can position himself or herself in any desired fashion on or within the craft.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What I claim is:

1. A personal watercraft comprising:

a hull on an underside of said watercraft, said hull having a singular construction and including a longitudinal curvature between a bow portion on a front end thereof and a stern portion on a rear end thereof;

wherein said hull further includes a curvature extending laterally from one lateral side of said hull to an opposing lateral side of said hull;

a recessed cavity on an upper side of said personal watercraft, said recessed cavity being adapted to receive the body of a rider in a prone position, wherein said recessed cavity includes an elevated chest portion, a pair of elevated lateral sides, and wherein said recessed cavity includes an area to accommodate a rider's feet within said personal watercraft;

whereby a rider may lie in said personal watercraft in a prone position so that said rider's body may be completely contained within said recessed cavity, and wherein said recessed cavity allows a rider's arms to hang over said lateral sides thereof, for purposes of propulsion and navigation.

2. The personal watercraft set forth in claim 1, wherein said area to accommodate a rider's feet includes a recessed area and a footrest for said rider's feet.

3. The personal watercraft set forth in claim 2, wherein said recessed cavity further includes a pair of recessed leg sections and a central pillar disposed therebetween.

4. The personal watercraft set forth in claim 1, further including an additional cushion layer disposed within said recessed cavity.

5. The personal watercraft set forth in claim 4, wherein said additional cushion layer is selected from the group consisting of neoprene and minicell foam.

6. The personal watercraft set forth in claim 1, wherein said personal watercraft is of a monolithic design.

7. A method of traversing water, said method comprising the steps of:

providing a personal watercraft including a hull on an underside thereof and a recessed cavity on an upper portion thereof, wherein said recessed cavity is adapted to receive a rider in a prone position therein, and wherein said hull includes a curvature extending laterally from one lateral side of said hull to an opposing lateral side of said hull;

positioning a rider in a prone position within said recessed cavity of said personal watercraft so that said rider may hang his or her arms over lateral sides of said watercraft into water and wherein said rider's legs and feet remain in said personal watercraft; and using said rider's arms to paddle and navigate said watercraft within said water.

8. The method set forth in claim 7, wherein said hull includes a longitudinal curvature between a bow portion on a front end thereof and a stern portion on a rear end thereof.

9. The method set forth in claim 7, wherein said recessed cavity includes an elevated chest portion, a pair of elevated lateral sides, and an area to accommodate a rider's feet.

10. The method set forth in claim 7, wherein said recessed cavity further includes a pair of recessed leg sections and a central pillar disposed therebetween.

11. The method set forth in claim 7, wherein said watercraft is of monolithic design.

12. The method set forth in claim 7, wherein said watercraft further includes an additional cushion layer disposed within said recessed cavity.

13. The method set forth in claim 12, wherein said additional cushion layer is selected from the group consisting of neoprene and minicell foam.

* * * * *